US006378144B1

(12) United States Patent
Yurchision

(10) Patent No.: US 6,378,144 B1
(45) Date of Patent: Apr. 30, 2002

(54) STRAPLESS SUPPORT SYSTEM FOR VESSELS SUCH AS SWIMMING POOLS

(75) Inventor: Peter P. Yurchision, Shavertown, PA (US)

(73) Assignee: Muskin Leisure Products, Inc., Midway, GA (US)

( * ) Notice: Subject to any disclaimer, the term of this patent is extended or adjusted under 35 U.S.C. 154(b) by 0 days.

(21) Appl. No.: 09/542,104

(22) Filed: Apr. 4, 2000

Related U.S. Application Data

(63) Continuation-in-part of application No. 09/272,824, filed on Mar. 19, 1999, which is a continuation of application No. 08/858,637, filed on May 19, 1997, now Pat. No. 5,884,347.

(51) Int. Cl.[7] ..... E04H 4/00; E04H 4/04
(52) U.S. Cl. ..... 4/506; 4/488; 52/169.7
(58) Field of Search ..... 4/488, 506; 52/169.7–169.9; 472/92, 96; 256/25, 30, 31

(56) References Cited

U.S. PATENT DOCUMENTS

| | | | | |
|---|---|---|---|---|
| 3,225,362 A | | 12/1965 | Barrera | |
| 3,466,676 A | | 9/1969 | Barrera | |
| 3,522,614 A | * | 8/1970 | Gould | 52/169.7 |
| 3,536,195 A | | 10/1970 | Oden | |
| 3,562,822 A | | 2/1971 | Wall | |
| 3,745,592 A | | 7/1973 | Wall | |
| 3,986,310 A | | 10/1976 | Van den Broek | |
| 4,062,158 A | | 12/1977 | Kaufmann et al. | |
| 4,812,087 A | | 1/1980 | Schall et al. | |
| 4,413,361 A | | 11/1983 | Wolf et al. | |
| 4,473,978 A | | 10/1984 | Wood | |
| 4,735,714 A | | 4/1988 | Schall | |
| 4,782,538 A | | 11/1988 | Chisholm et al. | |
| 5,231,807 A | | 8/1993 | Aymes | |
| 5,522,188 A | | 6/1996 | Cornelius | |
| 5,791,099 A | | 8/1998 | Duffy | |
| 5,884,347 A | | 3/1999 | Yurchision et al. | |

FOREIGN PATENT DOCUMENTS

| | | |
|---|---|---|
| DE | 1434861 | 2/1969 |
| DE | 2131988 | 1/1973 |
| DE | 19516204 | 11/1995 |
| EP | 0 879 924 A2 | 11/1998 |
| EP | 0 879 924 A3 | 11/1998 |
| FR | 1377887 | 2/1965 |

OTHER PUBLICATIONS

Promotional literature of Muskin Leisure Products, Inc. entitled "Europool."
English translation of German Patent No. 1434861, Sep. 1, 1998.
French Preliminary Search Report dated May 6, 1999 (2 pages).

* cited by examiner

*Primary Examiner*—Robert M. Fetsuga
*Assistant Examiner*—Tuan Nguyen
(74) *Attorney, Agent, or Firm*—Dean W. Russell, Esq.; Kristin D. Mallatt, Esq.; Kilpatrick Stockton LLP

(57) ABSTRACT

Support systems for vessels such as above-ground swimming pools are disclosed. Each system may include one or more buttresses adapted to support substantially the entire vertical height of the side wall or each of a series of side walls of the pool. A strapless support system to provide a pool having a deep end is also disclosed. The buttresses, which flare along their lengths, closely match the support they provide each side wall to the outward water pressure present along its height for enhanced reliability. The diminished space required for installation of the disclosed buttresses reduces the surface area required for their associated pool.

16 Claims, 5 Drawing Sheets

STRAPLESS SUPPORT SYSTEM FOR VESSELS SUCH AS SWIMMING POOLS

This application is a continuation-in-part of U.S. patent application Ser. No. 09/272,824, filed on Mar. 19, 1999, having the title "Support System for Vessels Such as Swimming Pools," which was a continuation of U.S. patent application Ser. No. 08/858,637, now issued as U.S. Pat. No. 5,884,347, filed May 19, 1997, having the same title, the entire contents of each of which are hereby incorporated by reference.

FIELD OF THE INVENTION

This invention relates to vessels such as swimming pools and more particularly to strapless support systems for above-ground swimming pools and to buttresses for walls of the above-ground swimming pools.

BACKGROUND OF THE INVENTION

The popularity of swimming pools, particularly in residential areas, continues to increase. This increased popularity is based at least in part on the availability of aesthetically appealing above-ground pools, whose durability permits cost-effective purchasing by consumers. Above-ground pools additionally are particularly useful in areas where substantial excavation is either impermissible or undesirable. In densely-populated regions, for example, residential lawns may not be sufficiently large to accommodate the space required for in-ground pools. Moreover, in some cases they may be inadequate to accommodate the equipment necessary to excavate in-ground pools, even if space for such pools exists. Alternatively, above-ground pools may be preferable because of the decreased time typically needed for installation (and, if necessary, removal) or the lesser maintenance requirements and costs often associated with them.

Many substantially-permanent above-ground pools are generally either circular or oval in shape, with each type comprising multiple vertical walls and a frame. Because of their strength, galvanized steel or other compositions are usually chosen as materials from which the walls are made. Nonetheless, water pressure present at and near the bottoms of filled pools often requires the walls of above-ground pools to be braced for reliable performance. This bracing requirement is particularly pertinent in connection with oval pools, whose elongated side walls are especially vulnerable to collapse from the outward pressure exerted by the water contained therein.

As a consequence of this vulnerability, existing oval above-ground pools are constructed with braces supporting the lower sections of their side walls. Each brace includes three pieces, denominated an "upright" portion, an "angled" portion, and a "connecting" portion. FIG. 1 illustrates such braces 10 of above-ground pool 14, whose generally oval shape requires use of multiple vertical side walls 18. As shown in FIG. 1, upright portion 22 extends upward from bottom 26 of side wall 18, with connecting portion 28 being either at ground level or buried underground. An end of each of upright portion 22 and angled portion 30 connects to a respective end of connecting portion 28, while the other end 34 of angled portion 30 attaches to upright portion 22. The resulting structure resembles the outline of a right triangle, with angled portion 30 constituting the hypotenuse.

FIG. 1 details the protruding nature of braces 10. Such braces 10 frequently extend outward several feet from side walls 18 on both sides of pool 14, increasing the surface area of the lawn required for installing the pool. This increased surface area can cause difficulties in installing pools in areas subject to covenants or zoning regulations, as insufficient land may remain post-installation to meet setback and other legal or contractual requirements. Braces 10 may also inhibit lawn maintenance adjacent pool 14 and, to some, may detract from the aesthetic appeal of the pool itself. The three-piece structure of each brace 10 additionally increases its associated manufacturing and installing cost, while supporting less than the entire vertical height of a side wall 18.

Furthermore, the nature of above-ground pools requires support straps that extend a substantial horizontal distance beneath the pool. Such straps render it difficult to construct a pool having a "deep" end because the straps run the substantial horizontal length of the pool and prevent the liner forming the bottom of the pool from filling a hole that has a depth extending below the straps. Removing the straps changes pressure allocations. It is thus desirable to provide a pool that alleviates the need for straps extending a substantial distance below the pool and that alleviates the protruding braces shown in FIG. 1, while providing support for a deep pool or a pool having a deep end. It is also desirable to provide such a pool that keeps the pool removable, i.e., that does not require a concrete fill and that is easy to assemble.

SUMMARY OF THE INVENTION

The present invention, by contrast, provides a support system intended to resolve these issues. Particularly suited for vessels such as elongated above-ground pools, the support system includes a set of, typically, one-piece buttresses adapted to support the entire vertical height of one or each of a series of side walls. The flared design of the buttress, furthermore, matches the support it provides the side wall to the outward water pressure present along its height for enhanced reliability, permitting use of fewer buttresses than the number of existing braces that would otherwise be necessary. The one-piece design of the buttress further eliminates some of the manufacturing and installation costs associated with existing braces, while its sleek appearance is more likely to please discerning observers.

The diminished footprint of the innovative buttress additionally reduces the surface area required for its corresponding pool. Setback and similar requirements thus pose fewer problems than with existing pools, permitting pools incorporating the present invention to be located in smaller (especially narrower) lawns. Consequently, more residential customers in densely-populated areas are able to situate these pools in the lawn space available to them, increasing the market for the pools beyond that existing today. Abolishing the open areas between the angled portions of current braces and the ground additionally avoids many of the difficulties associated with providing lawn care in those areas. Additionally, residential and other customers are able to enjoy pools having deep ends because of a feature that makes it possible to provide an area of the pool that is deeper than a standard installation provides.

In some embodiments of the invention, each buttress is a unitary structure whose height approximates that of the side wall or walls of its associated pool. At least one surface of the buttress contacts the side wall along substantially its entire height, supporting the height of the wall continuously against the outward pressure exerted when the pool is filled with water. Because the buttress defined by these embodiments flares along its height it assumes, in side elevational view, the general form of a truncated, solid triangle.

Embodiments of the buttress further comprise notched sections to retain the bottom rim of the pool—and therefore help retain the side walls—in place.

Additionally included in some support systems of the present invention may be elongated cross-members spanning the width of the pool. Often called "omegas" because of their cross-sectional appearance, the cross-members, when present, are buried so that only their upper surfaces are above the ground. Buttresses on each side of the pool may be bolted or otherwise attached to the upper surfaces to retain them in position relative to the ground. Protruding from the upper surface of a cross-member adjacent its ends are one or more tabs, which in use fit into slots in the bottom rim of the pool to maintain its position. The buttresses, side walls, bottom rim, and cross-members thus can interact to preserve the position and structure of the pool relative to the ground. Alternatively, the buttresses may extend below ground level and be bolted, interlocked, or otherwise connected or fitted to the cross-members.

A further option that may be included in some embodiments of the invention is a support system that alleviates the straps that extend below the pool. This feature may accompany the pool system or may be sold as a separate kit. It permits above-ground pool owners to have a deeper pool than is conventionally available.

It is therefore an object of the present invention to provide a system for supporting a vessel designed to be filled with water or similar fluid.

It is also an object of the present invention to provide a system including one or more buttresses for supporting the side wall or walls of an above-ground swimming pool.

It is a further object of the present invention to provide a system in which a buttress supports a wall of a pool substantially continuously along the height of the wall.

It is another object of the present invention to provide a system for supporting pool walls in which the supporting structures extend only minimally beyond the exteriors of the walls.

It is an additional object of the present invention to provide a system, including one or more buttresses, for supporting a vessel such as an above-ground pool, in which the buttresses comprise notched sections to retain the bottom rim of the pool in position.

It is yet another object of the present invention to provide a system for supporting an above-ground swimming pool in which buttresses, side walls, the bottom rim, and cross-members interact to maintain the position and structure of the pool relative to the ground.

It is also an object of this invention to provide a system for supporting an above-ground swimming pool that enables a deep pool or a pool having a deep end, while still maintaining the position and structure of the pool relative to the ground.

It is still a further object of this invention to provide a substantially strapless support system that uses plates and beams that support the pool relative to the ground, while incorporating buttresses that extend only minimally beyond the exterior of the walls.

Other objects, features, and advantages of the present invention will be apparent with reference to the drawings and remainder of the text of this application.

DETAILED DESCRIPTION

Figure 1:
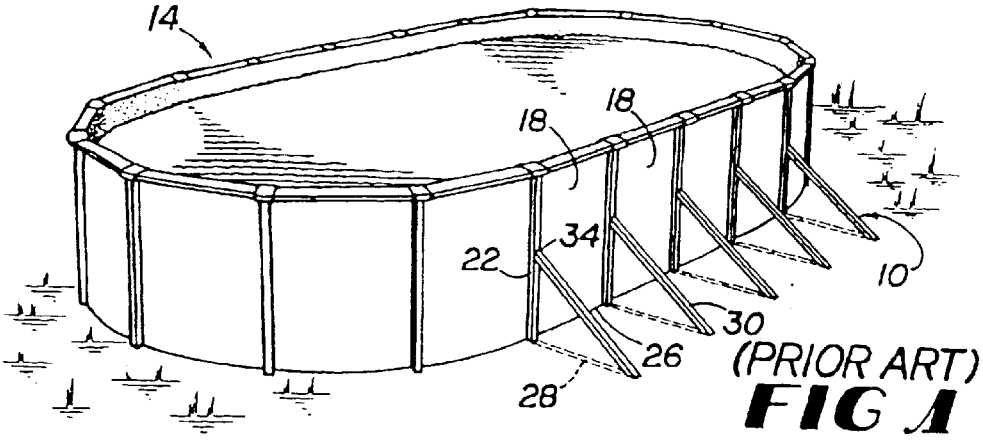
(PRIOR ART) FIG 1
FIG. 1 is a perspective view of an oval pool having an existing set of braces.
Figure 2:
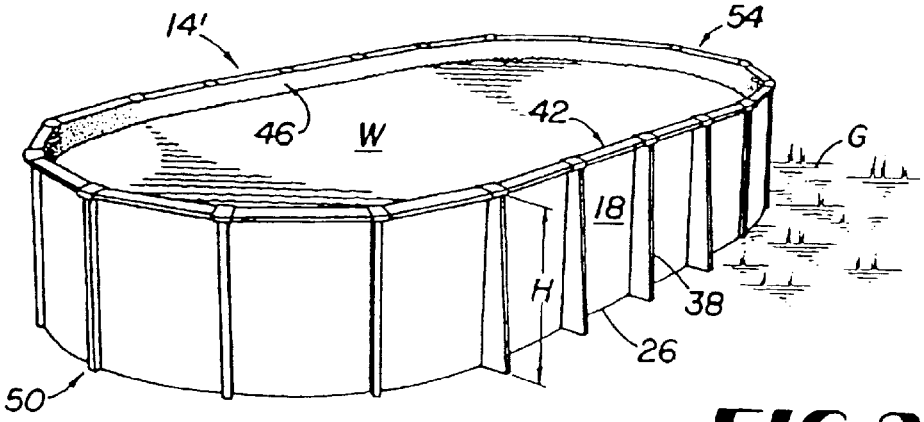
FIG. 2 is a perspective view of an oval pool utilizing a support system of the present invention.

FIGS. 2–5 and 7 illustrate buttresses 38 of the present invention. As shown in FIG. 2, buttresses 38 may be used in connection with pool 14' instead of braces 10. Doing so can diminish significantly the surface area required for installation of pool 14', permitting pool 14' to be positioned in areas inadequate for placement of pool 14. As noted earlier, setback and similar requirements additionally pose fewer problems for pool 14' because of its smaller overall size.

Figure 3:
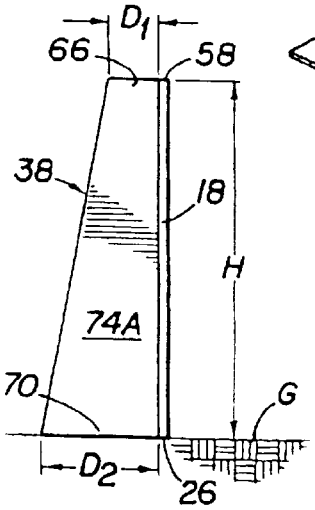
FIG. 3 is a side elevational view of a portion of the pool and of a buttress of the support system of FIG. 2.

FIGS. 2 and 3 detail typical locations of buttresses 38 in connection with pool 14'. Illustrated in FIG. 2 is a set of buttresses 38 spaced along side 42 of (generally) oval pool 14'. Although not shown in FIG. 2, a similar set of buttresses 38 may be spaced along opposite side 46 of pool 14'. Because pool 14' is oval, sides 42 and 46 are elongated relative to ends 50 and 54 and subject to greater stresses caused by the pressure of water W within the pool 14'.

This pressure within pool 14' additionally is greatest at bottom 26 of side wall 18 (adjacent ground G) and decreases toward the corresponding top 58 of the wall 18. To support the entirety of height H of side wall 18, the above-ground height of buttresses 38 may be substantially similar or identical to height H and, as shown in FIG. 3, most or all of their surfaces 62A and 62B (see FIGS. 4 and 7) may contact the side wall 18. To match more closely the support provided side wall 18 to the pressure of water W as a function of height H, buttresses 38 additionally may be flared in depth as illustrated in FIGS. 2 and 3. Such flaring results in buttress 38 having its minimum depth $D_1$ at its top 66 and its maximum depth $D_2$ at its bottom 70 (also adjacent ground G), with the depth increasing substantially continuously between top 66 and bottom 70. Buttress 38 thus resembles, in the side elevational view shown in FIG. 3, a right triangle.

Figure 4:
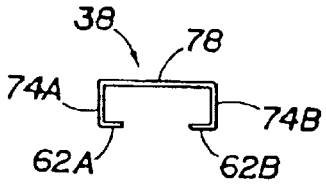
FIG. 4 is a top plan view of the buttress of FIG. 3.

Unlike brace 10, however, buttress 38 of FIG. 3 has solid sides 74A and 74B, a solid face 78, and is truncated at top 66. Surfaces 62A and 62B, moreover, function as flanges of buttress 38. The result is a unitary structure for buttress 38 that both provides greater and more uniform and continuous support for side wall 18 and has a sleeker profile than braces 10. Furthermore, for some embodiments of buttress 38, maximum depth $D_2$ does not exceed ten inches, an amount significantly less than the distance (typically thirty-six inches) from pool 14 that braces 10 protrude. Other dimensions of an exemplary buttress 38 include height between approximately forty-two and sixty inches, width of approximately four inches, and a minimum depth $D_1$ of approximately two to four inches. Buttress 38 is usually made of metal such as galvanized steel but may be manufactured of other materials when necessary or appropriate. The face 78, sides 74A and 74B, and surfaces 62A and 62B of buttress 38 additionally need not be integrally formed, although so forming them may avoid reducing the strength of the overall structure. Surfaces 62A and 62B also need not necessarily be formed at substantially right angles to respective sides 74A and 74B as shown in FIG. 4.

Figure 6:
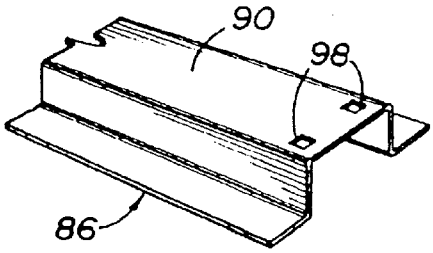
FIG. 6 is a perspective view of a portion of the cross-member of FIG. 5.
Figure 5:
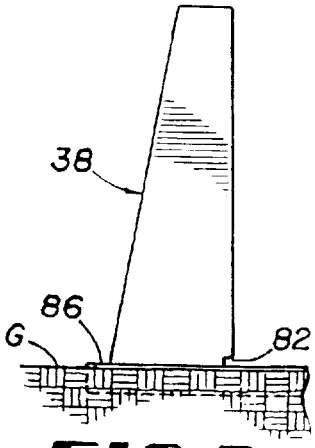
FIG. 5 is a side elevational view of the buttress of FIG. 3 together with a surface of a cross-member of the support system of the present invention.
Figure 7:
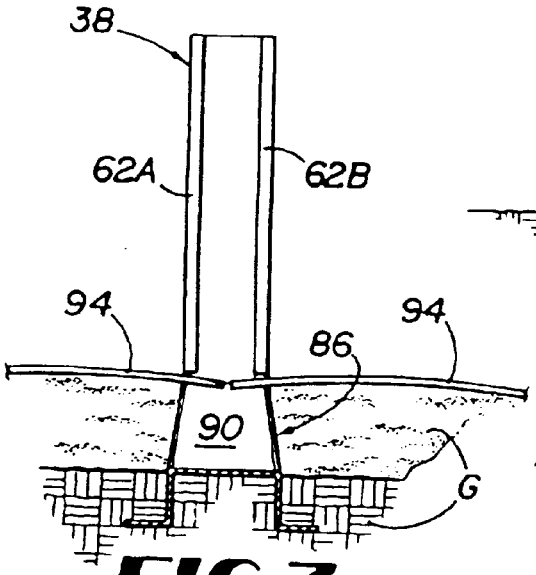
FIG. 7 is a (nominally) front elevational view of the buttress of FIG. 3 together with portions of the cross-member of FIG. 5 and the bottom rim of the pool of FIG. 2.

FIG. 5 illustrates notched section 82 of buttress 38. In use, buttress 38 may be connected (by bolts or other suitable means) to a cross-member 86 spanning the width of pool 14'. Such a cross-member 86 is shown in FIG. 6 and is buried in ground G so that only upper surface 90 is visible, and it is to this surface 90 that buttress 38 connects. Attaching buttress 38 to cross-member 86 in this manner thus retains the buttress 38 in position relative to ground G. Once buttress 38 is positioned, rim 94 (see FIG. 7) may be fitted into section 82 to assist in fixing its placement relative to the ground G. Slots of rim 94 additionally may receive tabs 98 protruding from upper surface 90 of cross-member 86 to complete its positioning. Side wall 18 may then be fitted into rim 94 in conventional fashion to retain it in place. Those skilled in the art will thus recognize that buttresses 38, side wall 18, rim 94, and cross-members 86 of the present invention may be designed if desired to interact appropriately to preserve the position and structure of pool 14' relative to the ground G.

Figure 8:
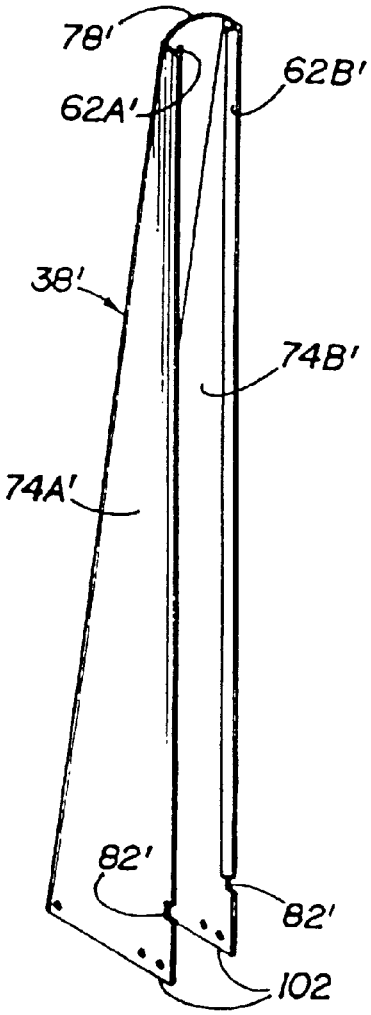
FIG. 8 is a perspective view of an alternative buttress of the present invention.

Shown in FIG. 8 is an alternative buttress 38'. Unlike corresponding components of buttress 38, face 78' of buttress 38' is curved, and surfaces 62A' and 62B' are formed at acute angles to respective sides 74A' and 74B'. Buttress 38' additionally extends beyond notched section 82' to terminate at lower edge 102, which in use is buried underground.

Figure 9A:
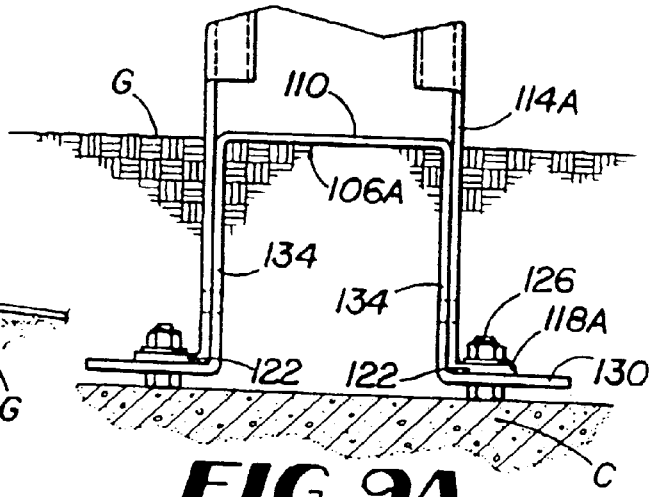
FIGS. 9A–C are (nominally) front elevational views of yet alternative buttresses and cross-members for use as support systems of the present invention.
Figure 9B:
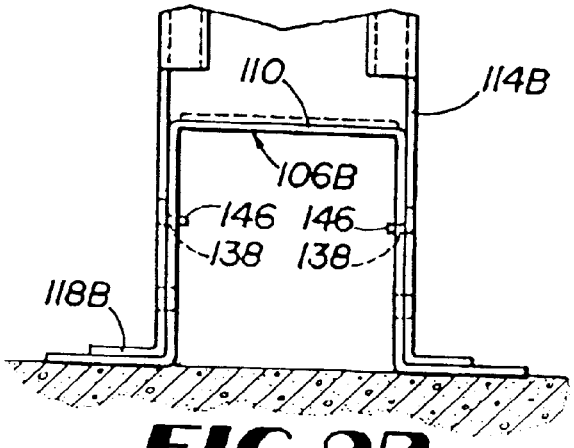
Figure 9C:
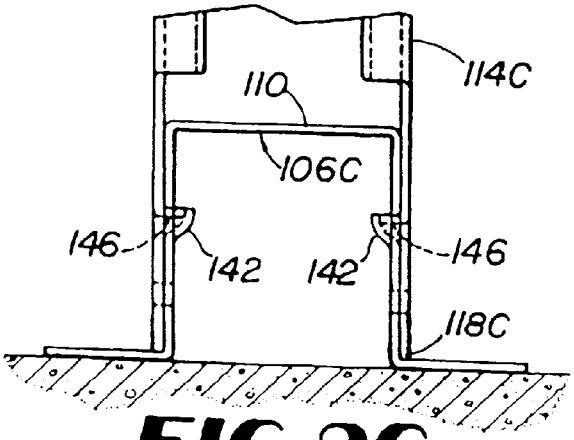

FIGS. 9A–C detail alternate cross-members 106A–C. Like upper surface 90 of cross-member 86, upper surfaces 110 of cross-members 106A–C are at or near the level of ground G. Similar to buttress 38', furthermore, buttresses 114A–C extend so that lower edges 118A–C are buried underground. In the buttress 114A of FIG. 9A, lower edges 118A are bent to form flanges 122, which include apertures in which bolts 126 or other fasteners may be placed. Horizontal sections 130 additionally include apertures for receiving bolts 126, thereby permitting buttress 114A to be fastened to cross-member 106A. By connecting buttress 114A to horizontal sections 130 rather than vertical sections 134 of cross-member 106A, bolts 126 are subjected to reduced shear stresses. Optionally excavating ground G to pour a concrete or other base C beneath horizontal section 130 may enhance the ability of buttress 114A to support a pool.

Cross-members 106B and 106C instead may include slots 138 or recessed segments 142 for receiving pins or tabs 146 of buttresses 114B or 114C. Such slots 138 or recesses formed by segments 142 effectively retain buttresses 114B or 114C in position relative to respective cross-members 106B or 106C by engaging, or interlocking with, tabs 146 below ground G. Although lower edge 118B is flanged and lower edge 118C is not, such edges 118B–C may be interchanged as necessary or desired. In any case, the result is a relatively secure positioning of a buttress 38', 114A, 114B, or 114C vis-à-vis a cross-member 106A, 106B, or 106C by connecting them underground.

Figure 10:
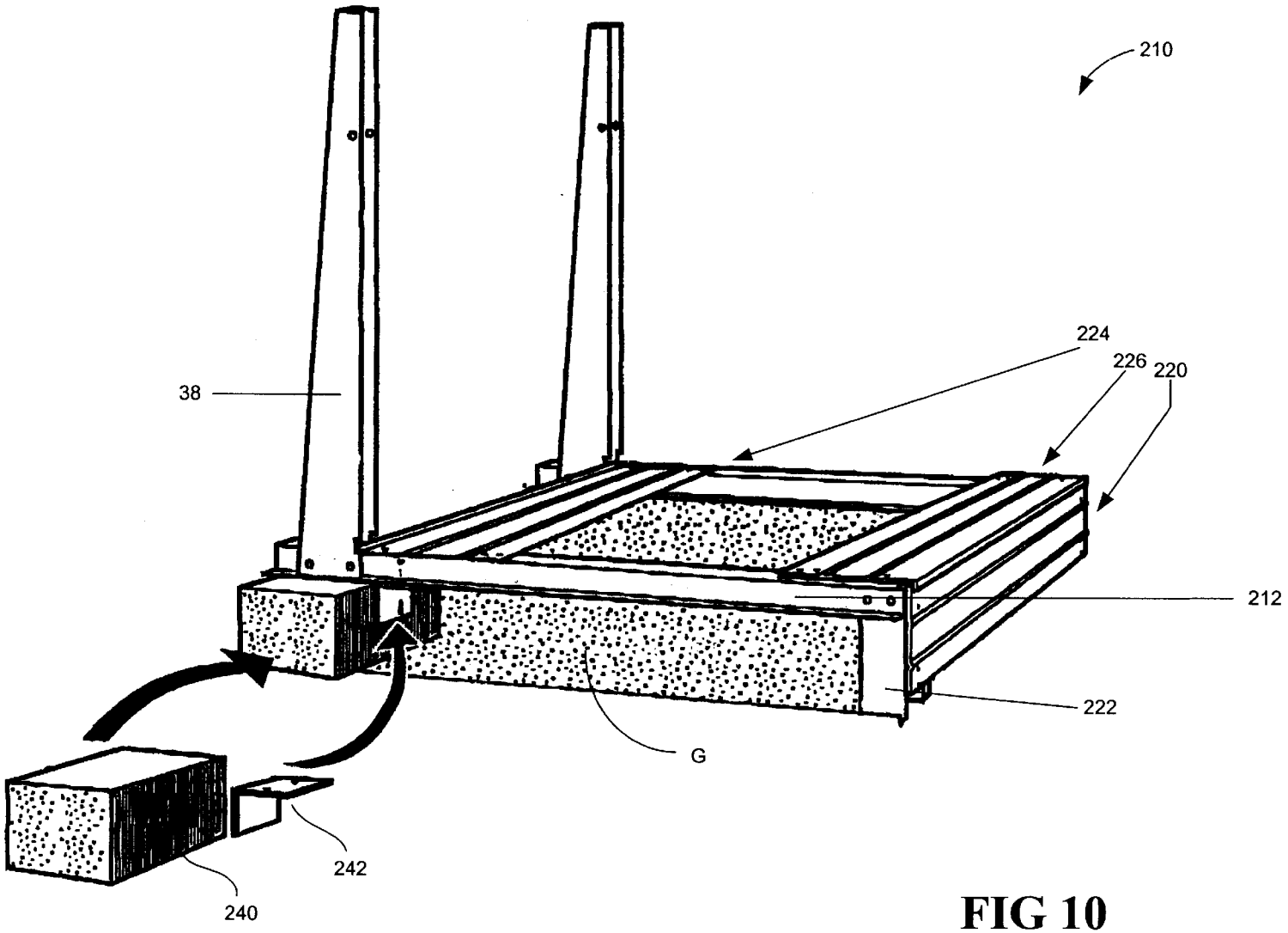
FIG. 10 is a perspective view of a portion of a strapless support system of the present invention.
Figure 11:
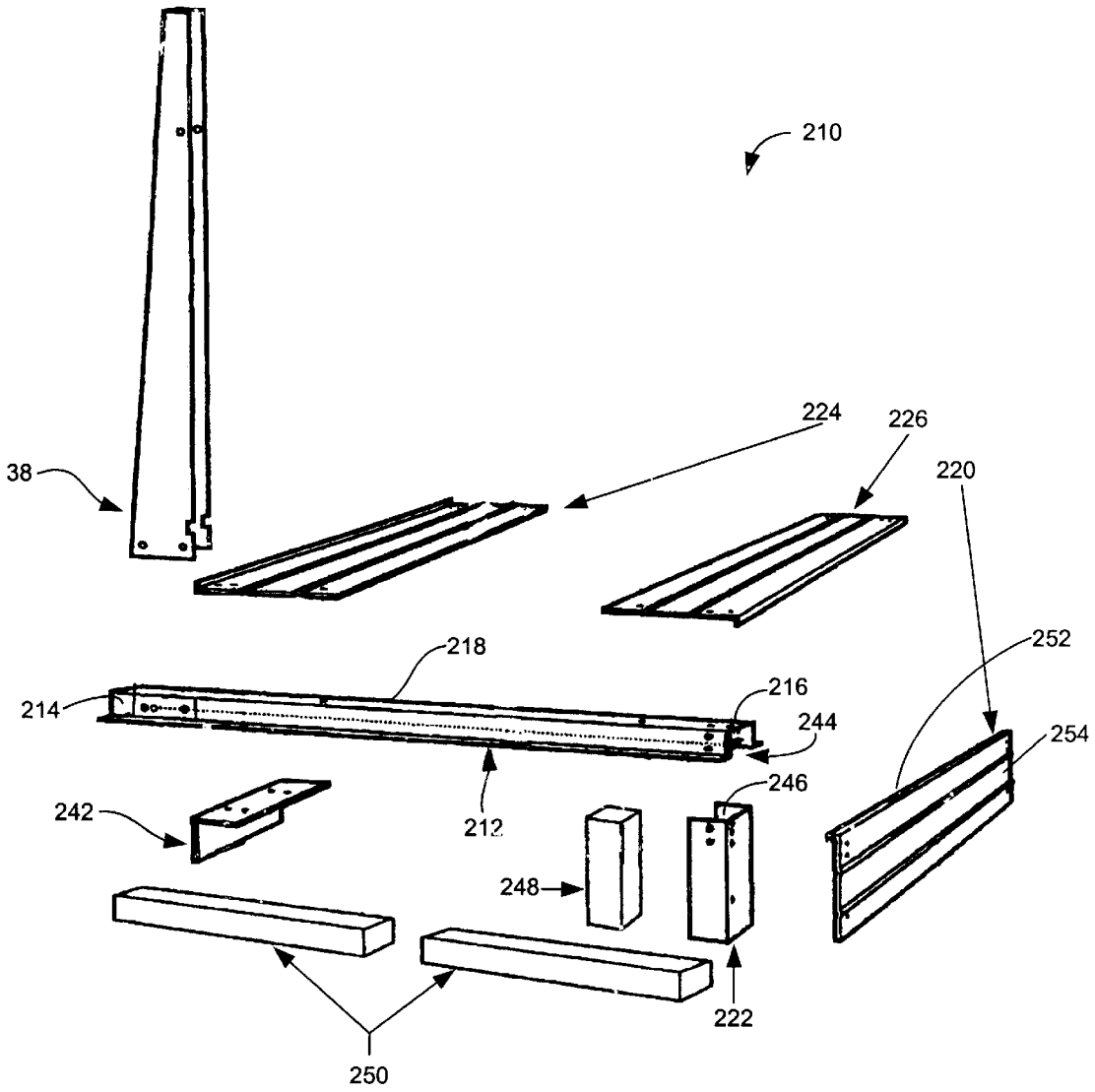
FIG. 11 is an exploded perspective view of the strapless support system of FIG. 10.

FIGS. 10–12 illustrate strapless support system 210 of the present invention. This system alleviates the use of at least one pair of straps that extend a substantial length underneath the water-containing portion of traditional above-ground pools. The system allows a deeper excavation area, but still provides support for the walls using a system of buttresses, cross-members, vertical beams, and a plates that support the walls against the pressure of the water in the pool.

If the system is sold as an expandable kit, intended to expand the size of an already-installed pool, it is possible to provide different sized kits for different sized pools. Such kits permit the pool to be deeper on just one side, i.e., a "deep end," or they may provide for a deeper pool in general.

As shown in FIG. 10, buttress 38 may be used in connection with alternate cross-members 212, plates 220, 224, and 226, and vertical beam 222. Similar to cross-member 86, alternate cross-member 212 is adapted to cooperate with buttress 38 and pool rim 94. More particularly, it may cooperate in any of the ways previously described. For example, alternate cross-member may cooperate with buttress 38 as illustrated and described in reference to FIGS. 9A–C or it may have a tab protruding from its horizontal upper surface 218 that may be received by slots of rim 94 in order to serve as a guide for the placement of rim 94, as discussed above.

Alternate cross-member 212, however, is also adapted to cooperate with vertical beam 222 and with plates 220, 224, and 226. In a preferred embodiment, each of two alternate cross-members 212, two associated vertical beams 222, and two buttresses 38, are supported by three plates 220, 224, and 226. However, it may be possible to achieve similar support effects using only two of the plates, i.e., using plate 220 and only one of plates 224 and 226 located anywhere along cross-member 212. The assembly is supported in the ground G by block 240, which is typically a concrete block, but may be made from any suitable material. Block 240 acts as a support to keep system 210 level in the ground G and to provide a means for suitable weight distribution. Any suitable support means may serve this purpose.

FIG. 11 details the location of alternate cross-member 212 in connection with the additional support system elements including buttress 38, vertical beam 222 and plates 220, 224, and 226. Cross member 212 may be any length that provides appropriate support for the system. A particularly suitable length for an alternate cross-member is about four feet. Buttress 38 (or 38' as shown in FIG. 8) is connected at or near the first end 214 of alternate cross-member 212 by means similar to those described above and has the features described above.

Vertical beam 222 has a channel 246, resembling a U-shaped channel, which in use cooperates with channel 244 of alternate cross-member 212. Vertical beam 222 is of a length and depth appropriate to provide support for the system, and preferably has a length of about twelve inches so that it appropriately stabilizes the system in the ground. Vertical beam 222 is usually made of metal such as galvanized steel but may be manufactured of other materials when necessary or appropriate. It is connected at or near the second end 216 of alternate cross-member 212 (by bolts, screws, or nuts, or other suitable means, non-limiting examples including truss head machine screws and hex nuts)

and is substantially perpendicular to the longitudinal axis of alternate cross-member 212.

Plates 220, 224, and 226 function to support and secure system 210 in place. They provide correct structural support for the system, i.e., ensure that the buttresses 38 are placed at correct distances from one another. Plates 220,224, and 226 also provide lateral support. They are usually made of metal such as galvanized steel, but may be manufactured from any suitable material. Plates 220, 224, and 226 may have various dimensions, exemplary dimensions including a range from about forty three inches to about forty seven inches. Plates 220, 224, and 226 may each have a flange 252 to facilitate connecting the plate to the system. Flange 252 may also act as a further support by "grabbing" ground G and alleviating any slippage that may occur when system 210 is in place. Plates 220, 224, and 226 may also have grooves 254 which prevent buckling that may occur if a flat plate is used, providing further structural support.

Front plate 220 also secures system 210 in ground G, as shown in FIG. 10. It also acts to "grab" into ground G, which is one of the aspects of system 210 that allows the removal of the traditional straps. Front plate 220 is connected to vertical beam 222 using suitable connecting means, such as those described above. Front plate 220 will be at an angle that is substantially perpendicular to cross-member 212. Plates 224 and 226 are connected to the horizontal upper surface 218 of alternate cross-member 212 at or near first and second ends 214 and 216, respectively, using suitable connecting means. As noted, although the three plates 220, 224, and 226 provide the preferred support, the invention may be practiced using less than the three plates 220, 224, and 226. For example it may be possible to retain only front plate 220 for support. The system 210 is shown as additionally supported by block 240 and angle brace 242.

FIG. 11 also illustrates optional inserts 250 and 248, which may be made of Styrofoam or other relatively pliable or pressure absorbing material, which may optionally be inserted into channel 244 of alternate cross-member 212 and channel 246 of vertical beam 222. Inserts 250 and 248 help prevent system 210 from sinking into ground G by providing a surface for ground G to abut. They essentially act as space-fillers to keep the dirt from entering channels 244 and 246. An optional angle brace 242 may be attached to alternate cross-member 212 to stabilize alternate cross-member on block 240. Angle brace 242 holds alternate cross-member 212 (and thus strapless support system 210) in place. Although angle brace 242 is particularly useful, any type of support or stabilization technique may be used to secure cross-member 212 on block 240.

Figure 12A:
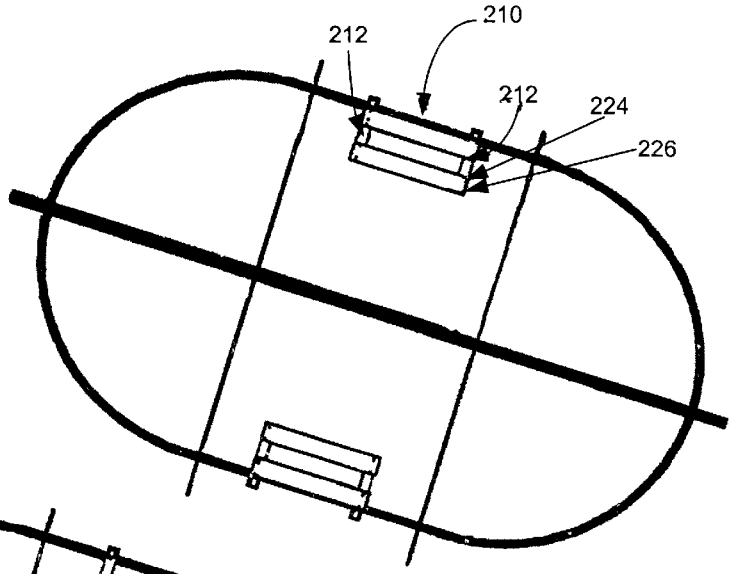
FIGS. 12A–B are top plan views of oval pools having a strapless support system of FIG. 10 installed at or near opposing sides of the pools.
Figure 12B:
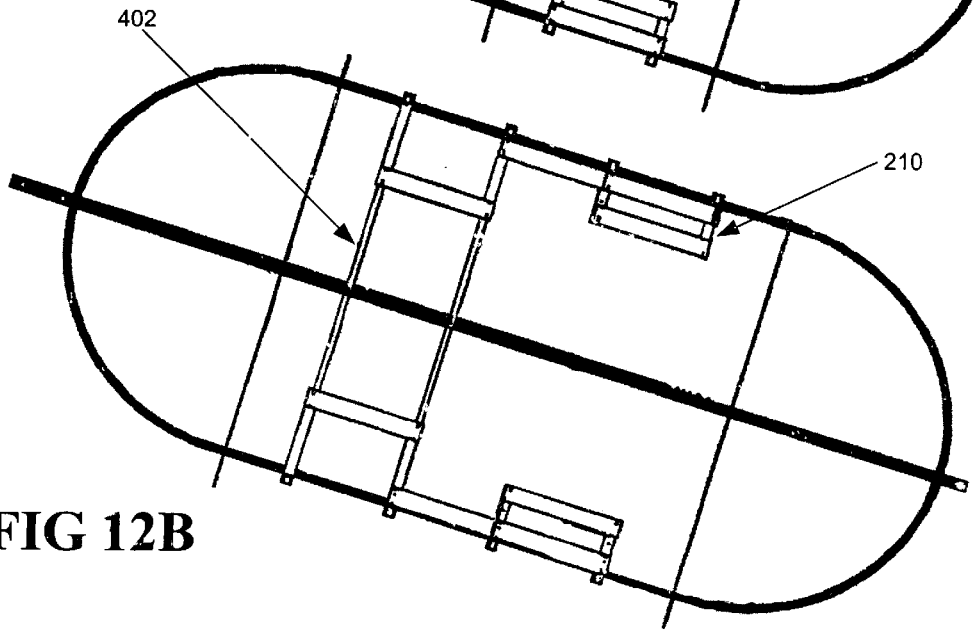

FIGS. 12A–B illustrate top plan views of the strapless support system 210 of this invention assembled and in place in the bottom of two types of pools. FIG. 12A shows the invention in connection with a relatively small pool, for example a fifteen by twenty-four foot pool. In this embodiment, system 210 completely replaces the conventional straps 402 (that are shown in FIG. 12B), with plates 220 (not shown), 224, and 226 and alternate cross-members 212. An expandable liner (not shown) is used with system 210 to line the pool and to provide a deep or deeper pool than would conventionally be available. FIG. 12B shows the system 210 located at or near opposing sides of the pool, replacing one set of straps in order to create a deep pool or a pool having a deep end. It may also be possible to completely replace straps 402 using one or more system 210 on a larger sized pool.

In order to deepen a pool or to provide a deep end, a preferred embodiment of the strapless support system 210 is assembled according to FIG. 10. Block 240 is placed in a trench in the ground G. The trench should correspond to the appropriate dimensions of the system components.

As detailed in FIG. 11, vertical beam 222 is attached to the second end 216 of alternate cross-member 212 and the buttress 38 is attached to the first end 214 of cross member 212. Front plate 220 is attached to vertical beam 222. Second and third plates 224 and 226 are attached to the top surface 218 of the alternate cross-member 212 at or near the first and second ends 214 and 216, respectively. Inserts 250 and 248 are then inserted into the channels 244 and 246 of the alternate cross-member 212 and vertical beam 222. An angle brace 242 or other form of support is installed on either the alternate cross member 212 at or near the first end 214 or on the block 240 to provide stability. The completed assembly may then be placed in the trench on block 240 and at least partially buried underground. The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A support system for maintaining in position a wall of an above-ground swimming pool defining an inner space, comprising:

(a) at least two buttresses adapted to contact the wall substantially continuously along its height;

(b) at least two cross-members having a first end and a second end, each in use cross-member cooperating with at least one buttress and the wall at the first end of the cross-member; and (c) at least two plates adapted to cooperate with the second end of each cross-member, the at least two separate plates in use being placed at a substantially perpendicular angle relative to one another in order to secure the support system in place in the ground, whereby the cross-members and the plates support the above-ground swimming pool without requiring support structure between a vertical end surface of the first end of each cross member, without extending through the entirety of the inner space, and without extending a substantial distance beyond the wall.

2. The system of claim 1, having first, second, and third plates, wherein the cross-members are separated a distance corresponding to the length of the plates, and wherein the first plate in use is coupled to the second end of both cross-members at an angle that is substantially perpendicular to the second and third plates.

3. The system of claim 2, further comprising at least two vertical beams adapted to cooperate with the second ends of the cross-members and that facilitate cooperation between the cross-members and the first plate.

4. A support system for maintaining in position a wall of an above-ground swimming pool designed to contain water, comprising:

(a) at least two cross-members, each having (i) a first end, (ii) a second end having a vertical end surface, and (iii) a substantially horizontal upper surface;

(b) at least two vertical beams which in use are coupled at or near the vertical end surface of the second ends of the cross-members at an angle that is substantially perpendicular to the cross-members;

(c) a first plate which in use is coupled to the vertical beams; and (d) at least one additional plate which in use is coupled to the horizontal upper surface of the cross-members.

5. The system of claim 4, wherein the at least one additional plate comprises second and third spacer plates which in use are coupled to the horizontal upper surface of the cross-member at or near the first and second ends, respectively.

6. The system of claim 4, further comprising blocks which in use support the cross-members; and at least two angle braces which are adapted to cooperate with the cross-members and the blocks and which stabilize the cross-members on the blocks.

7. The system of claim 4, wherein the vertical beams and the cross-members have channels located therein.

8. The system of claim 7, further comprising space-fillers which in use are inserted into the channels.

9. The system of claim 4, further comprising a substantially similar support system located at or near an opposing side of the above-ground pool.

10. A support system for maintaining in position a wall of an above-ground vessel, comprising:

(a) at least two cross-members, each having first and second ends and a substantially horizontal upper surface;

(b) at least two vertical beams which in use are coupled at or near the second ends of the cross-members at an angle that is substantially perpendicular to the cross-members;

(c) a first plate which in use is coupled to the vertical beams; and (d) second and third spacer plates which in use are coupled to the horizontal upper surface of the cross-member at or near the first and second ends, respectively, wherein the cross-members are adapted to have opposing ends of each of the first, second, and third plates coupled thereto and wherein the vertical beams in use are coupled at an angle that is substantially perpendicular to the cross-members at or near the second ends of the cross-members and to which opposing ends of the first plate are coupled.

11. The system of claim 10, further comprising first and second buttresses, the first buttress coupled at or near the first end of the first cross-member and the second buttress coupled at or near the first end of the second cross-member.

12. A strapless support system for maintaining in position a wall of an above-ground swimming pool designed to contain water, comprising:

(a) first and second cross-members, each having first and second ends and substantially horizontal upper surfaces;

(b) first and second vertical beams which in use are coupled at substantially right angles to the first and second cross-members, respectively, at or near the second ends of the cross-members;

(c) a first plate having first and second ends, the first end being coupled to the first vertical beam and the second end being coupled to the second vertical beam;

(d) second and third plates, each plate having first and second ends, the first ends of the second and third plates being coupled to the first cross-member and the second ends of the second and third plates being coupled to the second cross-member;

(e) at least two buttresses, one of which is coupled at or near the first end of the first cross-member, and one of which is coupled at or near the first end of the second cross-member;

(f) blocks, which in use support the first and second cross-members; and (g) angle braces which are coupled to the cross-members or to the blocks and which stabilize the first and second cross-members on the blocks.

13. The system of claim 12, further comprising a substantially similar support system located at or near an opposing side of the above-ground pool.

14. An above-ground pool having at least two ends with one end more deeply excavated than the other and an at least partially underground support system, the support system comprising a side wall bounding an interior space, the side wall supported by an assembly having at least two cross-members having a first end and a second end, each cross-member in use cooperating with at least one buttress and the wall at the first end of the coss-member, at least two separate plates placed at a substantially perpendicular angle relative to one another at the second end of a cross-member with at least one plate securing the support system in place substantially underground, wherein the support system is configured such that it does not require support structure between a vertical end surface of the first end of each cross member and does not extend a substantial distance beyond the exterior of the pool nor does it extend a substantial distance through the interior space of the deeply excavated end.

15. The support system of claim 14, wherein the side wall is supported by a buttress that contacts the side wall substantially continuously along its height, the buttress being supported by the assembly which enables the interior space to define a deep area, the assembly comprising cross-members, vertical beams, and relatively angled plates, all of which cooperate to support the wall without extending the substantial length of the interior space of the pool.

16. A method for deepening an above-ground pool designed to contain water, comprising:

(a) providing at least two cross-members adapted to cooperate with a vertical beam, a buttress, and a plate, the cross-members each having first and second ends, a top surface, and a channel;

(b) attaching a vertical beam having a channel to the second end of each of the cross-members;

(c) attaching a buttress to the first end of each of the cross members;

(d) attaching a first plate to the vertical beams;

(e) attaching second and third plates to the top surface of the cross-members at or near the first and second ends, respectively;

(f) inserting inserts into the channels of the cross-member and vertical beam;

(g) installing angle braces to the cross members, to form a completed assembly; and (h) placing the completed assembly on blocks located in trenches wherein the cross-members are at least partially buried underground.

* * * * *